US007556573B2

(12) United States Patent
Beach

(10) Patent No.: US 7,556,573 B2
(45) Date of Patent: Jul. 7, 2009

(54) FIELD HOCKEY TRAINING DEVICE

(76) Inventor: Emily J. Beach, 7207 Denton Rd., Bethesda, MD (US) 20814

( * ) Notice: Subject to any disclaimer, the term of this patent is extended or adjusted under 35 U.S.C. 154(b) by 130 days.

(21) Appl. No.: 11/812,845

(22) Filed: Jun. 22, 2007

(65) Prior Publication Data

US 2008/0318713 A1 Dec. 25, 2008

(51) Int. Cl.
*A63B 69/00* (2006.01)
*A63B 59/00* (2006.01)
*A63B 59/12* (2006.01)

(52) U.S. Cl. ..... 473/446; 473/422; 473/568; 473/560

(58) Field of Classification Search ..... 473/446, 473/422, 560, 558, 559, 561–564, 568, 201, 473/295

See application file for complete search history.

(56) References Cited

U.S. PATENT DOCUMENTS

| | | | | | |
|---|---|---|---|---|---|
| 1,305,952 | A | | 6/1919 | Suesman | |
| 2,086,062 | A | * | 7/1937 | Bray | 473/302 |
| 3,606,326 | A | * | 9/1971 | Sparks et al. | 473/300 |
| 3,679,209 | A | * | 7/1972 | Wexstaff | 273/129 R |
| 3,720,410 | A | * | 3/1973 | Saytar | 473/562 |
| 3,804,413 | A | * | 4/1974 | Hrivnak | 473/295 |
| 3,834,714 | A | * | 9/1974 | Smolinski | 473/201 |
| 3,940,134 | A | * | 2/1976 | Bieganowski | 473/560 |
| D244,790 | S | * | 6/1977 | Carlson et al. | D21/727 |
| D251,861 | S | * | 5/1979 | Carbonero | D21/727 |
| 5,011,145 | A | * | 4/1991 | Bartkowicz | 473/568 |
| 5,342,046 | A | | 8/1994 | Erb | |
| 5,413,339 | A | * | 5/1995 | Martin | 473/295 |
| 5,603,498 | A | * | 2/1997 | Crawford et al. | 473/563 |
| 6,406,387 | B1 | | 6/2002 | Ryan | |
| 6,500,079 | B1 | * | 12/2002 | Tucker, Sr. | 473/513 |
| 6,547,683 | B1 | * | 4/2003 | Howgate | 473/560 |
| 6,783,471 | B2 | | 8/2004 | Bolduc et al. | |
| 6,904,615 | B2 | * | 6/2005 | Kobe et al. | 2/161.8 |
| 6,949,036 | B2 | | 9/2005 | Cisar et al. | |
| 2001/0041626 | A1 | * | 11/2001 | Madelle et al. | 473/295 |
| 2006/0122013 | A1 | | 6/2006 | Dodge et al. | |

FOREIGN PATENT DOCUMENTS

| | | | |
|---|---|---|---|
| GB | 2205757 | A * | 12/1988 |
| GB | 2298799 | A * | 9/1996 |

OTHER PUBLICATIONS

"FIH, Rules of Hockey 2007-2008", International Hockey Federation, 2006.

* cited by examiner

*Primary Examiner*—Mitra Aryanpour
(74) *Attorney, Agent, or Firm*—Welsh & Flaxman LLC

(57) ABSTRACT

A field hockey training device includes a handle having a shaft. The shaft includes a first end and a second end with a longitudinal axis extending between the first end and the second end. The training device includes a head shaped and dimensioned for playing field hockey extending from the first end of the shaft. The handle further includes a first gripping member positioned along the handle adjacent the second end of the shaft and a second gripping member positioned along the handle adjacent to the second end of the shaft located between the first gripping member and the first end of the shaft. The second gripping member is supported on the shaft for rotation about the longitudinal axis of the shaft.

3 Claims, 5 Drawing Sheets

FIELD HOCKEY TRAINING DEVICE

BACKGROUND OF THE INVENTION

1. Field of the Invention

The invention relates to a field hockey training apparatus. More particularly, the invention relates to a field hockey training device resembling a conventional field hockey stick, but including a rotatable grip member for supporting a player's lower hand.

2. Description of the Related Art

Although field hockey has grown in popularity over the years, no training sticks have been developed to help younger players in the development of skills that will enhance their play, expedite the learning process and ultimately provide for greater enjoyment of the game.

One technique which is often very difficult for younger players to master is permitting the stick to rotate relative to the lower hand such that the flat side of the head is rotated from side to side in a manner allowing a player to contact the ball only with the flat side of the stick. As those skilled in the art will certainly appreciate, field hockey is a "one-handed" sport and, as such, the lower hand is always the player's right hand and the upper hand is always the player's left hand. With this in mind, there is a need for training devices to assist developing players in mastering this skill. The present invention is such a field hockey training device.

SUMMARY OF THE INVENTION

It is, therefore, an object of the present invention to provide a field hockey training device including a handle having a shaft. The shaft includes a first end and a second end with a longitudinal axis extending between the first end and the second end. The training device includes a head shaped and dimensioned for playing field hockey extending from the first end of the shaft. The handle further includes a first gripping member positioned along the handle adjacent to the second end of the shaft and a second gripping member positioned along the handle adjacent to the second end of the shaft located between the first gripping member and the first end of the shaft. The second gripping member is supported on the shaft for rotation about the longitudinal axis of the shaft.

It is also an object of the present invention to provide a field hockey training device wherein the field hockey training device is between approximately 24 inches and approximately 38 inches long.

It is another object of the present invention to provide a field hockey training device wherein the head includes a hooked head with a heel bend.

It is a further object of the present invention to provide a field hockey training device wherein the head complies with all governing rules of field hockey.

It is also a further object of the present invention to provide a field hockey training device wherein the shaft includes a circumferential recess and the second gripping member is positioned within the recess for rotation about the longitudinal axis of the shaft.

It is also another object of the present invention to provide a field hockey training device wherein the second gripping member is an annular, cylindrical member and includes an outer gripping surface.

It is yet another object of the present invention to provide a field hockey training device wherein the gripping member further includes an inner bearing surface that rotates about an outer bearing surface of the circumferential recess.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
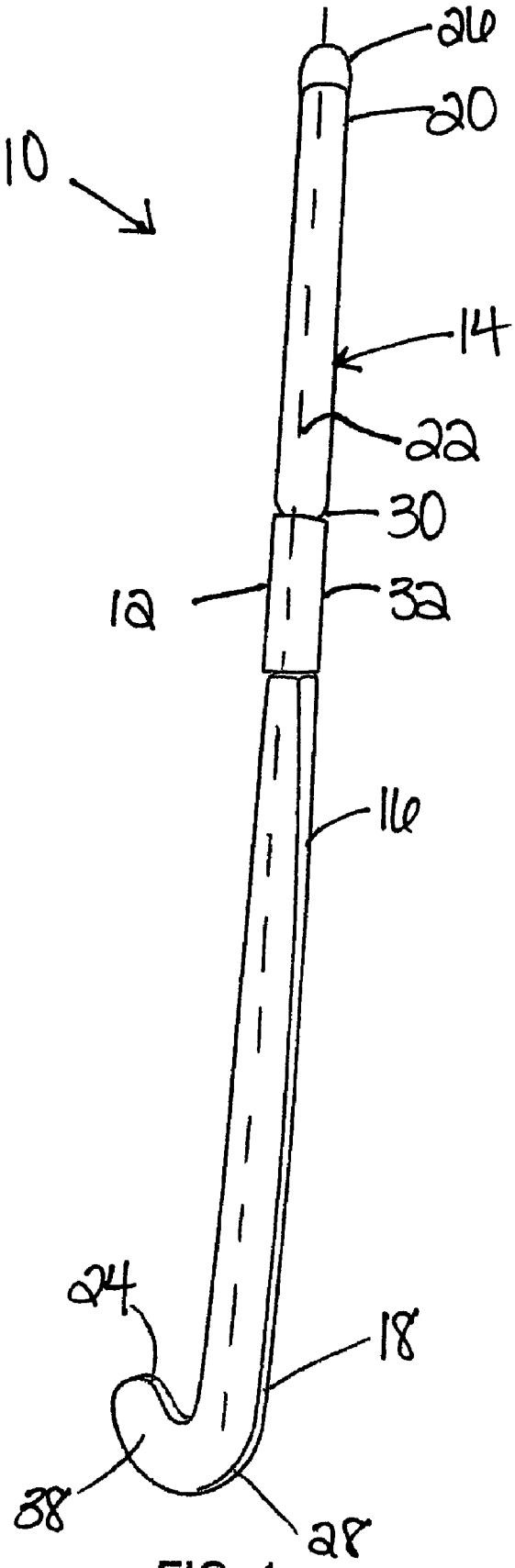
FIG. 1 is a perspective view of a field hockey training device in accordance with the present invention.
Figure 2:
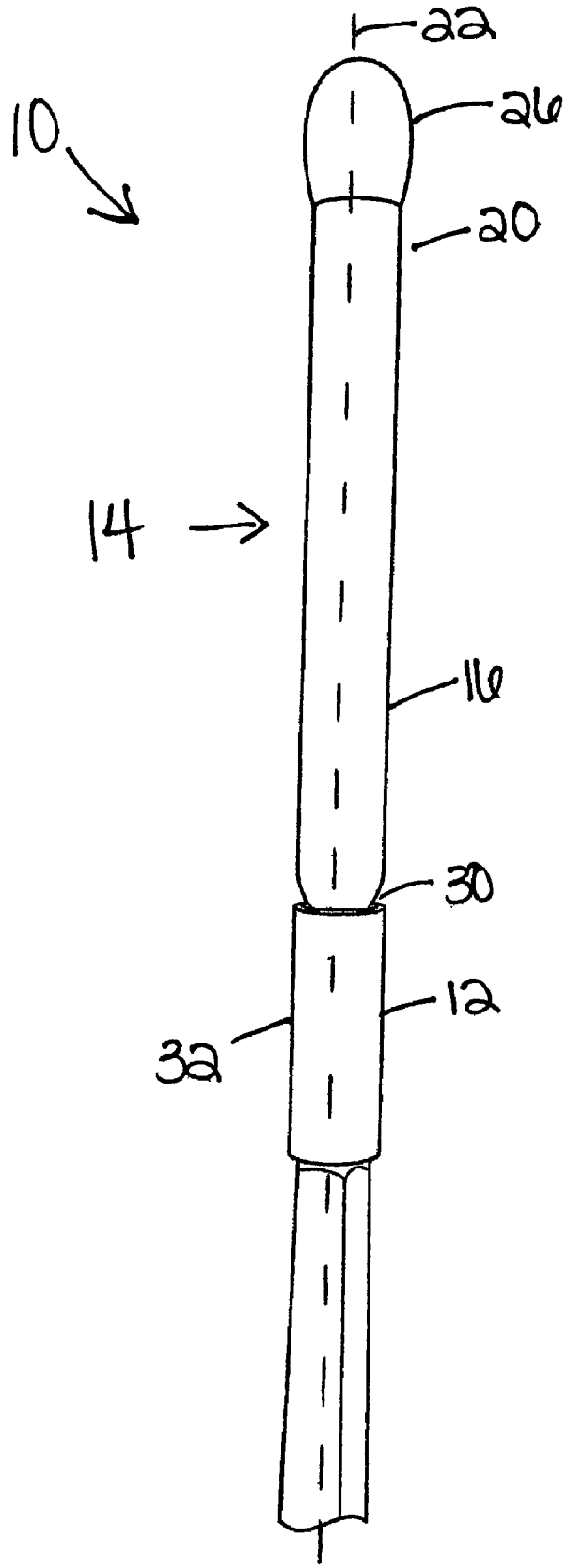
FIGS. 2, 3 and 4 are detailed perspective views of the field hockey training device shown in FIG. 1.
Figure 3:
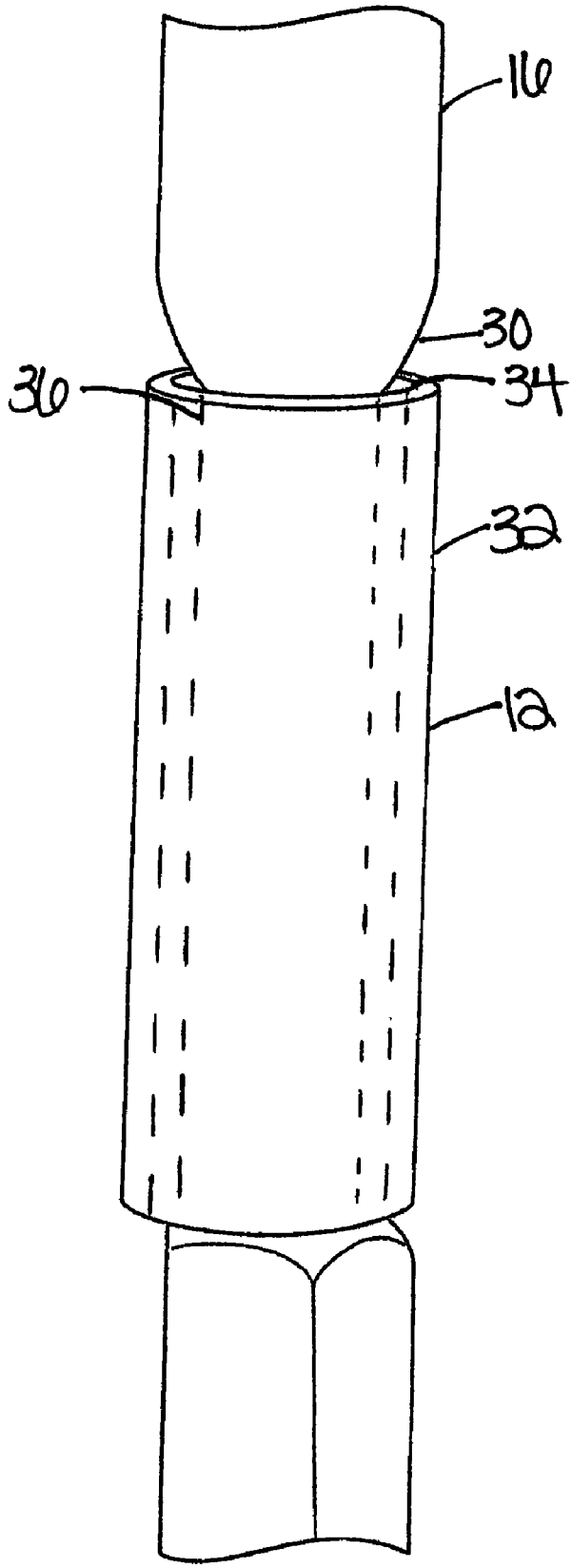
Figure 4:
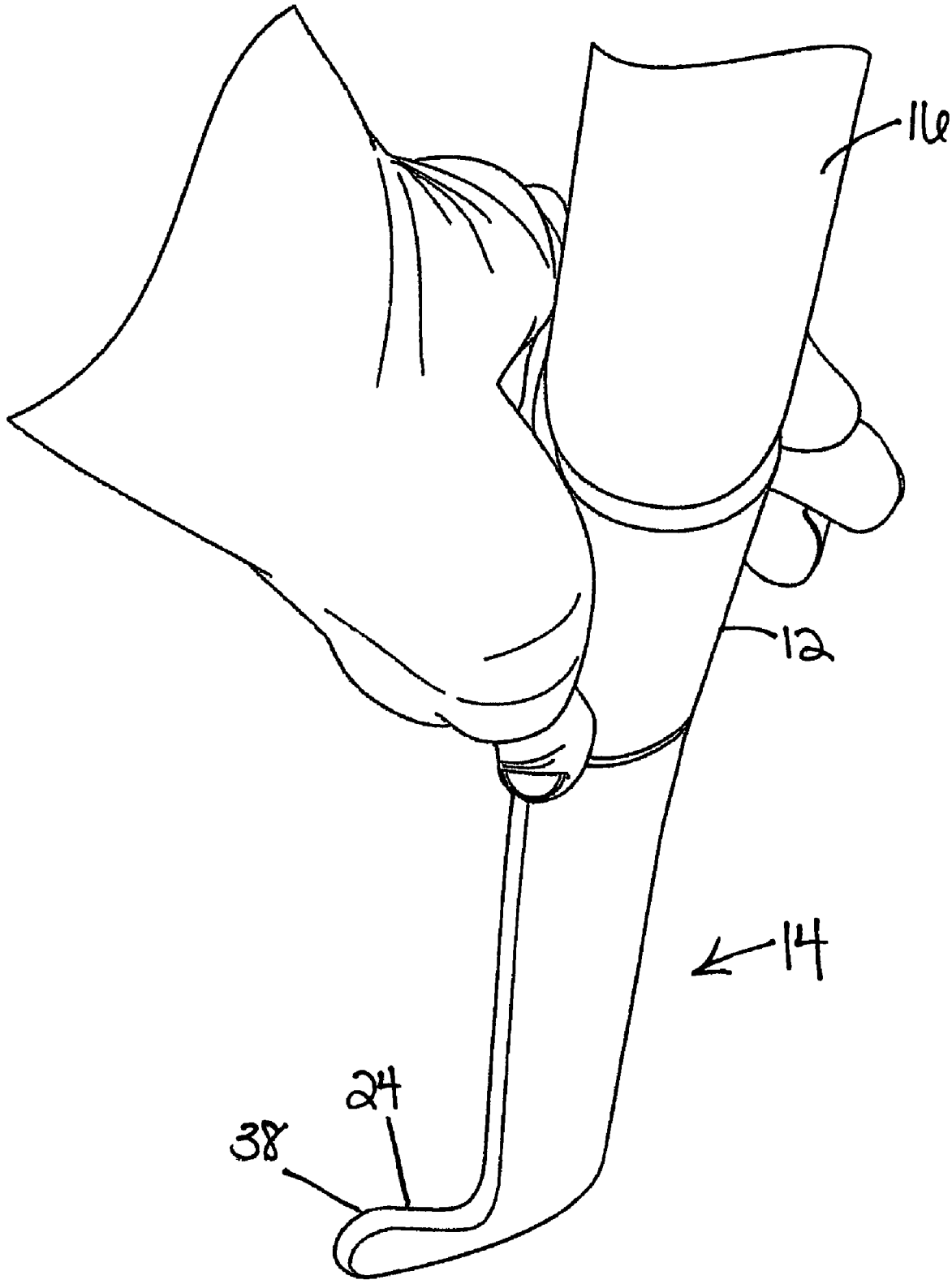

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

With reference to FIGS. 1 to 4, a field hockey training device 10 is disclosed. The field hockey training device 10 resembles a conventional field hockey stick, but includes a rotating second gripping member 12 for supporting the lower hand (that is, the right hand) of a field hockey player as he or she practices stick work.

In particular, the field hockey training device 10, in accordance with the present invention, includes a handle 14 composed of an elongated shaft 16 having a first end 18, a second end 20 and a longitudinal axis 22 extending between the first end 18 and the second end 20. A head 24 shaped and dimensioned for playing field hockey extends from the first end 18 of the shaft 16. A first gripping member 26 is positioned along the handle 14 adjacent to the second end 20 of the shaft 16. The second gripping member 12 is positioned along the handle 14 adjacent to the second end 20 of the shaft 16 and between the first gripping member 26 and the first end 18 of shaft 16. As a result, the first gripping member 26 is positioned for gripping by the upper hand (that is, the left hand) of a field hockey player and the second gripping member 12 is positioned for gripping by the lower hand of a field hockey player. The second gripping member 12 is supported on the shaft 16 for rotation about the longitudinal axis 22 of the shaft 16 in a manner permitting the handle 14 to be rotated relative to the lower hand of a field hockey player as he or she uses the present field hockey training device 10.

More particularly, and as briefly discussed above, the present field hockey training device 10 generally resembles a conventional field hockey stick. As such, the field hockey training device 10 is between approximately 24 inches and approximately 38 inches long and is made of either wood or composite materials. Where composite materials are utilized, a combination of fiberglass, Kevlar and carbon fiber composites is commonly employed, although those skilled in the art will appreciate that a variety of materials may be utilized in the manufacture of the present training device.

As discussed above, the field hockey training device 10 includes a head 24 and a handle 14. The handle 14 includes a shaft 16 having a first end 18 and a second end 20 with a longitudinal axis 22 extending therebetween. The handle 14 further includes a first gripping member 26 rigidly coupled to the shaft 16 adjacent to the second end 20 of the shaft 16. The first gripping member 26 is rigidly secured to the shaft 16 and is shaped and dimensioned in a conventional manner for gripping by the upper hand of the user as he or she manipulates the present field hockey training device 10. The handle 14 also includes a second gripping member 12 positioned along the handle 14 adjacent to the second end 20 of the shaft 16 and between the first gripping member 26 and the first end 18 of the shaft 16. However, the second gripping member 12 is supported on the shaft 16 for rotation about the longitudinal axis 22 of the shaft 16. As will be discussed below in greater detail, by allowing for rotation of the second gripping member 12 about the longitudinal axis 22 of the shaft 16, training relating to the pivoting and utilization of a field hockey training device 10 is enhanced.

With regard to the head 24 of the field hockey training device 10, it is a conventional head. As such, it includes a hooked head 24 with a heel bend 28 extending about an arc in accordance with conventional field hockey stick construction. As those skilled in the art will certainly appreciate, today there is a choice of angle of hook upturns, including 45 degrees, 60 degrees, and 70 degrees. As those skilled in the art will also appreciate, the shape and dimensions of the hook may be varied to suit specific needs and applications, and consequently may be formed as a shorty, midi or maxi head within the spirit of the present invention. Those skilled in the art will also appreciate other permitted head configurations may be employed without departing from the spirit of the present invention. However, and in accordance with current field hockey rules, the head 24 must be formed within specific parameters to be within the bounds of the field hockey rules. As such, and in accordance with the present invention, the head 24 of the present field hockey training device 10 should be designed to comply with all governing rules of field hockey. The rules as established by the International Hockey Federation are set forth in FIH, Rules of Hockey 2007-2008, International Hockey Federation (2006), which is incorporated herein by reference. Attention is particularly directed to Pages 52-56 of the "Rules".

In addition, the handle 14 must be manufactured to comply with all rules relating to the manufacture of field hockey sticks, including permitted bow of the field hockey stick.

With reference to the second gripping member 12, the shaft 16 includes a circumferential recess 30 extending about the shaft 16. The second gripping member 12 is positioned within this circumferential recess 30 and is designed to rotate about the longitudinal axis 22 of the shaft 16 as it sits within the circumferential recess 30. With this in mind, the second gripping member 12 is generally an annular, cylindrical member which includes an outer gripping surface 32 and an inner bearing surface 34. The inner bearing surface 34 rotates about an outer bearing surface 36 of the circumferential recess 30 formed along the shaft 16. In this way, the second gripping member 12 may readily rotate about the longitudinal axis 22 while maintaining its position along the handle 14. In accordance with a preferred embodiment, the second gripping member 12 is made of PVC pipe and has a diameter of approximately 1 inch and a length of approximately 4 inches, although other materials and dimensions are contemplated in accordance with the present invention.

In accordance with a preferred embodiment, the PVC pipe is split, positioned about the shaft within the circumferential recess, and then the split ends of the pipe are resecured using adhesive or screws. As those skilled in the art will certainly appreciate, various bearing structures, other than the PVC pipe riding upon the shaft, may be employed within the spirit of the present invention.

In use, the player will grip the first gripping member 26 with his or her upper hand and grip the second gripping member 12 with his or her lower hand. At this point the player may go through a series of dribbling drills while pivoting the field hockey training device 10 through the action of the upper hand such that the flat surface 38 of the head 24 comes into contact with only the ball. Because the second gripping member 12 permits free rotation of the shaft 16 thereabout, the field hockey training device 10 may be rotated in a controlled manner while the player learns to allow rotation of the field hockey training device 10 relative to her or his lower hand.

Figure 5:
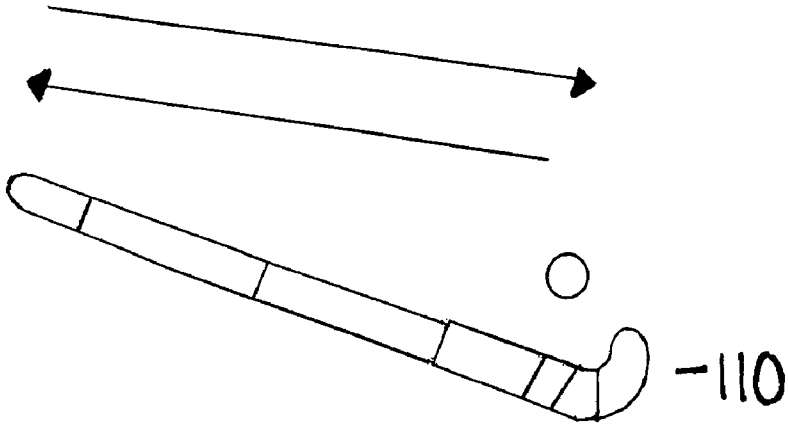
FIGS. 5 and 6 are schematics showing various dribbling drills that may be utilized in conjunction with the present field hockey training device.
Figure 6:
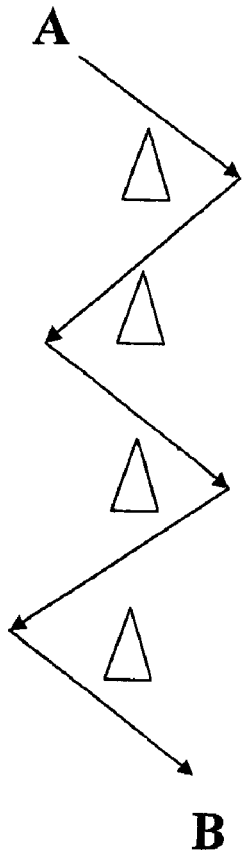

FIGS. 5 and 6 show schematics of training regiments that may be utilized are disclosed. With reference to FIG. 5, a player would dribble the ball back and forth across an extra stick 110 lying on the ground. The player would stay stationary while dribbling and reversing the orientation of the present field hockey training device such that only the flat surface 38 of the head 24 of the field hockey training device 10 contacts the ball. With reference to FIG. 6, the player would start at point A and finish at point E. The player would weave in and out of the cones with the ball following the arrows and the field hockey training device 10 being turned such that the flat surface 38 of the head 24 comes into contact with only the ball.

While the preferred embodiments have been shown and described, it will be understood that there is no intent to limit the invention by such disclosure, but rather, is intended to cover all modifications and alternate constructions falling within the spirit and scope of the invention.

What is claimed is:

1. A field hockey training device, comprising:

a handle having a shaft including a first end and a second end with a longitudinal axis extending between the first end and the second end, the shaft including a circumferential recess having an outer bearing surface;

a head shaped and dimensioned for playing field hockey extending from the first end of the shaft;

the handle further including a first gripping member positioned along the handle adjacent to the second end of the shaft and a second gripping member positioned along the handle adjacent to the second end of the shaft located between the first gripping member and the first end of the shaft, wherein the second gripping member is positioned within the circumferential recess of the shaft;

the second gripping member being supported on the shaft and within the circumferential recess for rotation about the shaft, the second gripping member including an inner bearing surface that rotates about the outer bearing surface of the circumferential recess in a manner permitting rotation of the shaft relative to the second gripping member while a player simultaneously grips the first gripping member and the second gripping member.

2. The field hockey training device according to claim 1, wherein the field hockey training device is between approximately 24 inches and approximately 38 inches long.

3. The field hockey training device according to claim 1, wherein the head includes a hooked head with a heel bend.

* * * * *